US008668107B2

(12) United States Patent
Decker et al.

(10) Patent No.: US 8,668,107 B2
(45) Date of Patent: Mar. 11, 2014

(54) MODULAR RECYCLER

(75) Inventors: Nicholas Decker, Concord, NC (US); Bradley Hooley, Charlotte, NC (US); David McNamara, Huntersville, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 149 days.

(21) Appl. No.: 13/296,729

(22) Filed: Nov. 15, 2011

(65) Prior Publication Data

US 2012/0118784 A1 May 17, 2012

Related U.S. Application Data

(60) Provisional application No. 61/414,166, filed on Nov. 16, 2010.

(51) Int. Cl.
*E05D 7/10* (2006.01)

(52) U.S. Cl.
USPC ..... 220/503; 220/500; 220/501; 220/502; 220/504; 220/505; 221/102; 221/304; 221/96; 221/98; 222/546

(58) Field of Classification Search
USPC ..... 220/500–505, 1 T, 23.83, 524; 221/102, 221/304, 96, 98; 222/546
See application file for complete search history.

(56) References Cited

U.S. PATENT DOCUMENTS 1,021,872 A * 4/1912 Kingsbury ..... 220/503
4,971,202 A 11/1990 Box
4,982,857 A 1/1991 Sher
4,991,737 A 2/1991 Edelman
5,022,548 A * 6/1991 Stakis ..... 220/23.83
5,072,852 A * 12/1991 Smith et al. ..... 220/495.09
5,108,000 A 4/1992 Stoll et al.
5,111,958 A 5/1992 Witthoeft
D329,313 S 9/1992 Ward et al.
5,167,343 A 12/1992 Winfrey et al.
5,239,729 A * 8/1993 Scholl ..... 16/257
5,284,268 A 2/1994 Marsan et al.
5,381,921 A * 1/1995 Bray et al. ..... 220/495.08
5,445,397 A 8/1995 Evans
5,611,270 A 3/1997 Harrington
6,062,416 A * 5/2000 Smillie ..... 220/524
6,209,978 B1 4/2001 Khan
6,276,553 B1 * 8/2001 Vulcano ..... 220/495.06
6,540,103 B2 * 4/2003 Silvers ..... 221/96
D481,509 S 10/2003 Perelli (Continued)

OTHER PUBLICATIONS

Rubbermaid Commercial Products, LLC et al., International Application No. PCT/US2009/063504, International Preliminary Report on Patentability/Written Opinion, May 19, 2011, 7 pages.

*Primary Examiner* — Anthony Stashick
*Assistant Examiner* — Cynthia Collado
(74) *Attorney, Agent, or Firm* — Dennis J. Williamson; Moore & Van Allen PLLC

(57) ABSTRACT

A modular recycling unit comprises a support for supporting a first container. The first container is tiltable between a first position where the interior of the container is accessible and a second position where the interior of the container is inaccessible. The first container is freely removable from the support. A second container is supported on the support such that it is in a stacked relationship relative to the first container. The second container is freely removable from the support.

18 Claims, 9 Drawing Sheets

(56) References Cited

U.S. PATENT DOCUMENTS

| | | | | |
|---|---|---|---|---|
| 7,290,674 | B1 * | 11/2007 | Ledford | 220/507 |
| D586,972 | S | 2/2009 | Yang et al. | |
| 7,500,579 | B2 * | 3/2009 | Crossley | 220/703 |
| D618,417 | S | 6/2010 | Presnell | |
| 8,006,859 | B2 * | 8/2011 | Clarke | 220/500 |
| 2003/0178430 | A1 | 9/2003 | Wentz et al. | |
| 2010/0116822 | A1 | 5/2010 | Perelli et al. | |

* cited by examiner

MODULAR RECYCLER

This application claims benefit of priority under 35 U.S.C. §119(e) to the filing date of to U.S. Provisional Application No. 61/414,166, as filed on Nov. 16, 2010, which is incorporated herein by reference in its entirety.

BACKGROUND

The invention relates to recycling containers. Recycling programs are relatively common in most communities. Many recycling programs require the user to separate recyclable articles based on the material of the article such as plastics, papers and the like.

SUMMARY

A modular recycling unit comprises a support for supporting a first container. The first container is tiltable between a first position where the interior of the container is accessible and a second position where the interior of the container is inaccessible. The first container is freely removable from the support. A second container is supported on the support such that it is in a stacked relationship relative to the first container. The second container is freely removable from the support. A lid is pivotably secured to the second container and rotatable about a pivot axis between a first closed position and a second position where the lid may be completely removed from the container.

The support may comprise a generally horizontally disposed lower base and a stanchion that extends vertically from the lower base. A top surface of the lower base may define a supporting surface for the lower container. The stanchion may support a generally horizontal upper base that is spaced from the lower base a distance that allows the first container to fit between the upper base and the lower base where the upper base supports the second container. When the first container is in the second position an opening of the first container may be disposed beneath the upper base. The first container may comprise a bottom including a rear portion and an a front portion disposed at an angle relative to the rear portion such that a fulcrum is created between the rear portion and the front portion. The first container may tilt on the fulcrum between the first position and the second position. A foot pedal may rotate the first container about the fulcrum. The fulcrum may comprise a rounded projection on one of the support and the bottom of the first container that is received in a recess on another one of the bottom of the first container and the support. The lid may be attached to the second container at a releasable hinge. One of the lid and the second container may comprise a cylindrical pocket comprising a circular bearing surface having a passage that communicates to the exterior of the pocket and another one of the lid and the second container may be formed with a pin mounted for rotational movement in the pocket such that in a first orientation of the pin relative to the pocket the pin may be removed from the pocket. The passage may have a gap of a first width and the pin may have an oblong shape with a length dimension that is greater than a width dimension and the length dimension is greater than the first width and the width dimension is smaller than the first width. In the first orientation the longitudinal axis of the pin is aligned with the passage.

A modular recycling unit comprises a support for supporting a first container. The first container is tiltable between a first position where the interior of the container is accessible and a second position where the interior of the container is inaccessible. The first container is freely removable from the support. A second container is supported on the support such that it is in a stacked relationship relative to the first container. The second container is freely removable from the support. A first movable member circumscribes approximately one half of the circumference of the first container and is pivoted at each end to the first container such that the first movable member may rotate between a first position where it is disposed adjacent the opening of the first container and a second position where it extends substantially away from the first container; and a second movable member circumscribes approximately another half of the circumference of the first container and is pivoted at each end to the container such that it may rotate between a first position where it is disposed adjacent the opening of the first container and a second position where it extends substantially away from the container. The first and second members form handles in the first position and a bag lock in the second position such that a bag liner may be trapped between the first and second members and the first container when the first and second members are in the second position.

A third movable member may circumscribe approximately one half of the circumference of the second container and is pivoted at each end to the second container such that the third movable member may rotate between a first position where it is disposed adjacent the opening of the second container and a second position where it extends substantially away from the second container. A lid may be pivotably secured to the second container and rotatable about a pivot axis between a first closed position and a second position where the lid may be completely removed from the container. The support may comprise a generally horizontally disposed lower base and a stanchion that extends vertically from the lower base wherein a top surface of the lower base defines a supporting surface for the lower container and wherein the stanchion supports a generally horizontal upper base that is spaced from the lower base a distance that allows the first container to fit between the upper base and the lower base. The upper base may support the second container. When the first container is in the second position an opening of the first container may be disposed beneath the upper base. The first container may comprise a bottom including a rear portion and an a front portion disposed at an angle relative to the rear portion such that a fulcrum is created between the rear portion and the front portion. The first container may tilt on the fulcrum between the first position and the second position. A foot pedal may rotate the first container about the fulcrum.

DETAILED DESCRIPTION OF EMBODIMENTS OF THE INVENTION

Figure 1:
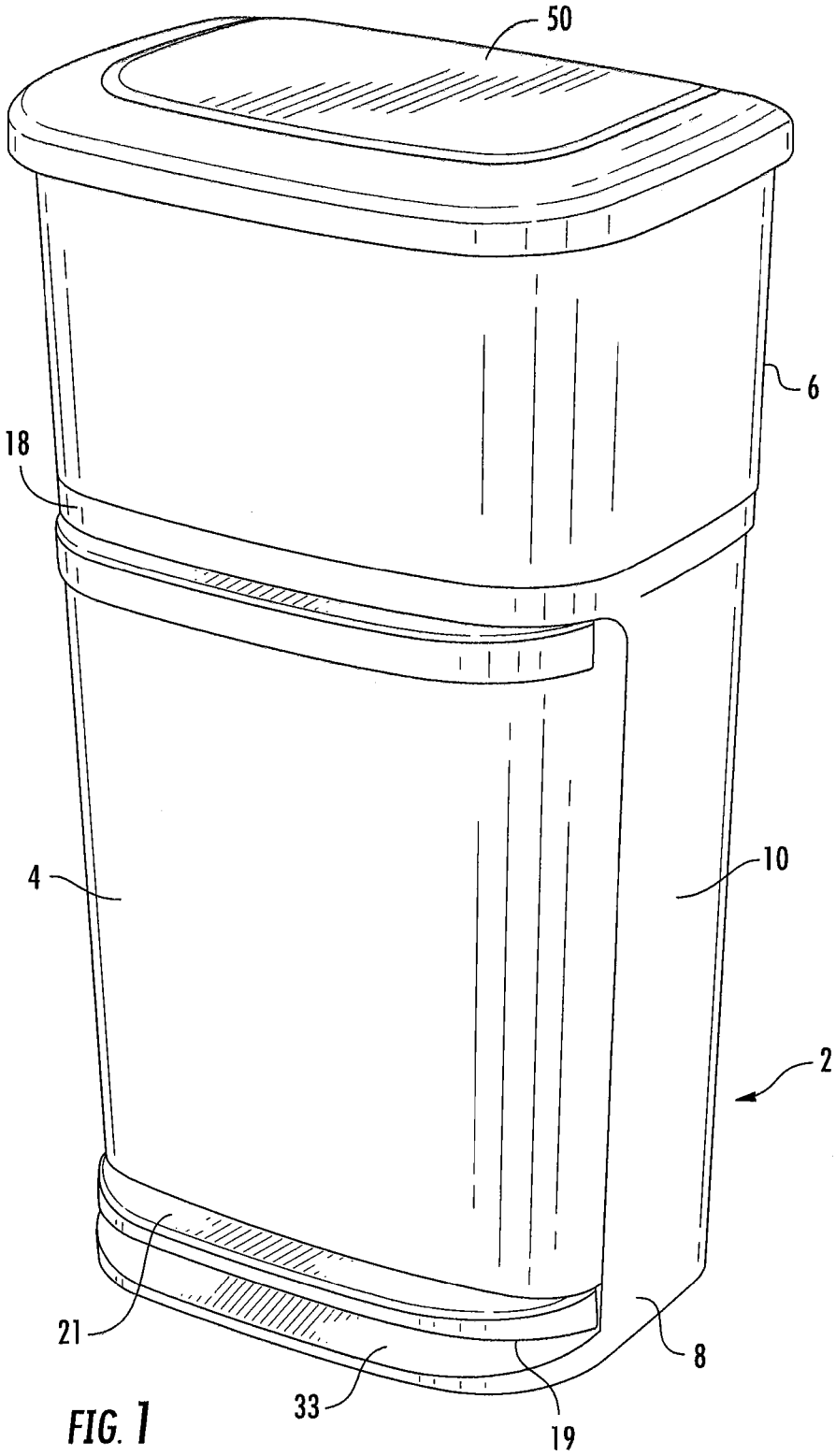
FIG. 1 is a perspective view of one embodiment of the modular recycling unit of the invention in the closed positions.

Referring to the figures, one embodiment of the modular recycling unit of the invention is shown comprising a support 2 that removably supports two separate containers 4 and 6. The support 2 comprises a generally horizontally disposed lower base 8 that may be supported on a floor or other surface. A stanchion 10 extends vertically from the base 8. The stanchion 10 may be located along the rear of base 8 such that the top surface 12 of base 8 defines a supporting surface for supporting the lower container 4. The stanchion 10 supports an upper generally horizontal upper base 18 that is spaced from the lower base 8 a distance that allows the lower container 4 to fit into the space defined between the upper base 18 and lower base 8. Upper base 18 creates a supporting surface for supporting the upper container 6.

The lower container 4 is dimensioned to fit on top of base 8 and to fit between the upper base 18 and the lower base 8. Lower container 4 comprises a bottom wall 13 connected to a vertically extending side wall 14 to define an interior space 15 that is accessed through a top opening 16 defined by rim 5. The container 4 may be tilted between a vertical closed position (FIGS. 1 and 5) where the opening 16 is disposed beneath the upper base 18 and access to interior space 15 is prevented and a tilted open position (FIGS. 2-4) where the top of the container 4 is tilted away from base 18 and access through opening 16 to interior space 15 is allowed.

The bottom 13 of container 4 includes a rear portion 17 that creates a substantially horizontal surface on which the container 4 rests when the container is in the upright, closed position of FIG. 1. The bottom of container 4 also includes an upwardly sloping front portion 19 that extends along the front of the container and that is disposed at an upward angle relative to the rear portion 17. The front portion includes an extension 21 that projects beyond the wall 14 of the container to create a foot pedal that may be operated by a user's foot. A fulcrum P is created at the intersection between the rear portion 17 and the front portion 19 along the width of the container 4 where container 4 pivots on fulcrum P between the upright, closed position and the tilted, open position. The fulcrum P is formed of a recess 23 that extends the width of the bottom of the container 4 and a rounded projection 25 that is formed on the surface 12 of base 8 that is received in recess 23 when the container is positioned on base 8. To tilt the container 4 from the upright closed position to the tilted open position a user may step on pedal 21 causing the container 4 to pivot about fulcrum P as recess 23 pivots over projection 25. Alternatively, a user may pull on handle 29 formed along the rim of container 4 to rotate container 4 about fulcrum P to move the container to the tilted open position. The container 4 pivots until upwardly sloping front portion 19 rests on downwardly slopping platform 33 of base 8. In one embodiment the front portion 19 extends at approximately a 9.5 degree angle relative to the rear portion 17 and platform 33 slopes approximately 9.5 degrees relative to horizontal such that the angle of rotation of the container 4 is approximately 19 degrees relative to vertical. To close the container the user pushes on the front top edge of the container 4 to rotate the container back to the upright closed position. The underside of upper base 18 is formed with a downwardly extending stop 31 that is engaged by an upwardly extending projection 33 on the rim 5 of the container 4 to stop rotation of the container at the open position shown in FIG. 2.

The container 4 may also be completely removed from the support 2 to allow a user to discard the contents of container 4 by inverting the container. The container 4 may be removed by sliding it out of the support 2 substantially horizontally. Enough clearance is provided to allow the back edge of the top edge of the container 4 to clear projection 33 when recess 23 is unseated from projection 25.

Figure 4:
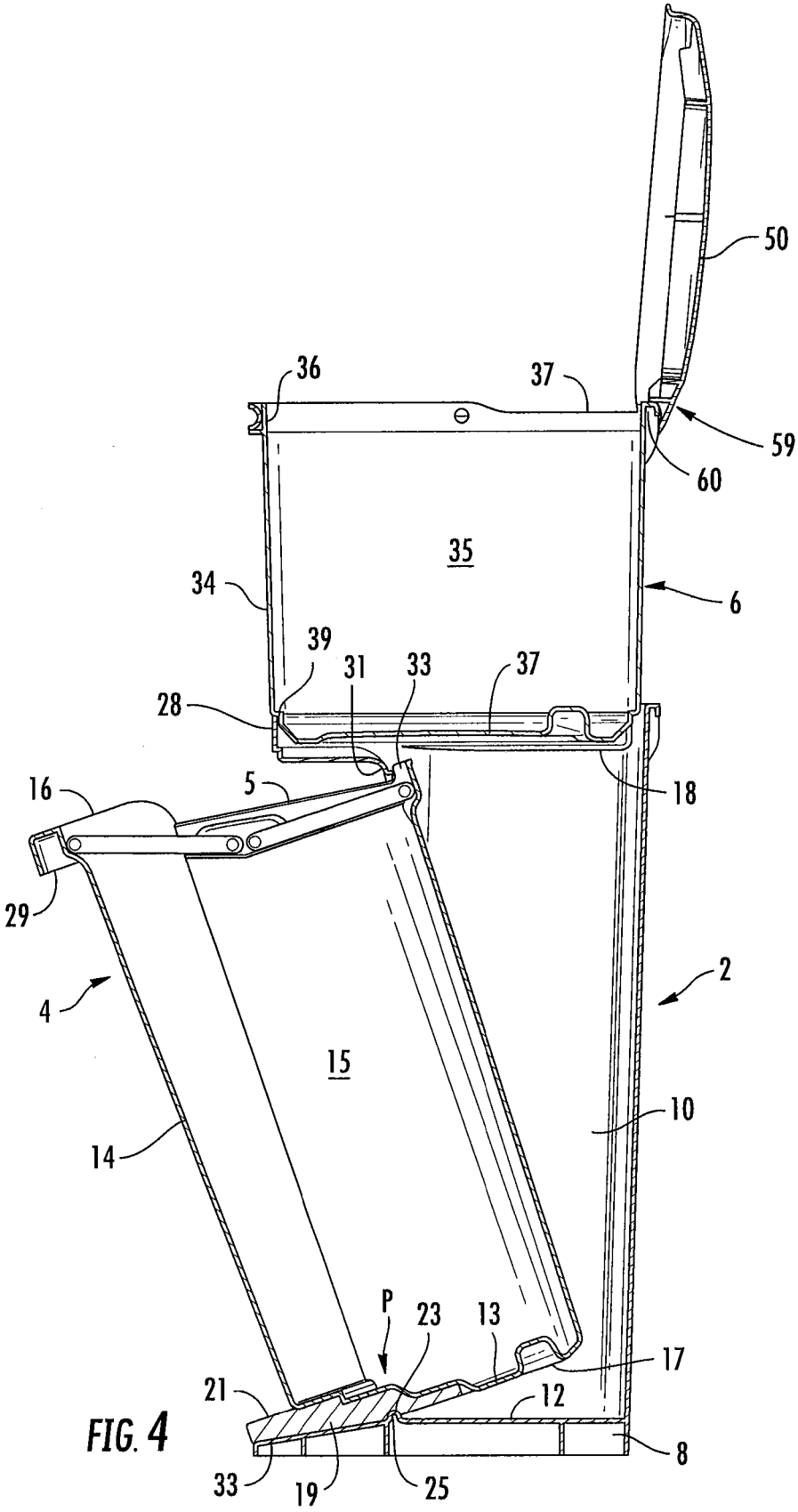
FIG. 4 is a side section view of the embodiment of the modular recycling unit of FIG. 1 in the open positions.
Figure 5:
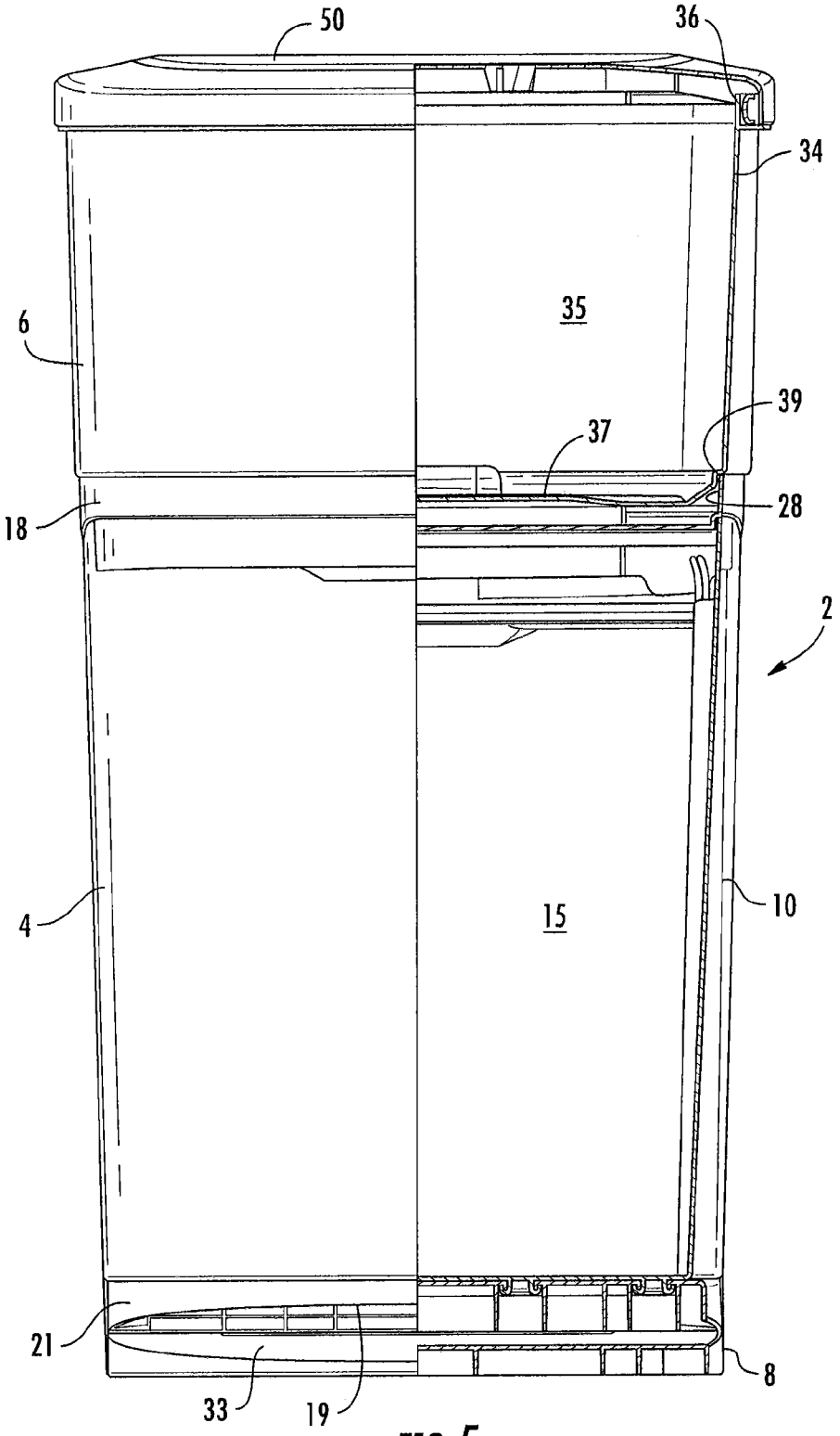
FIG. 5 is a partially cut-away front view of the embodiment of the modular recycling unit of FIG. 1.

Referring to FIGS. 4 and 5, the upper container 6 is shaped and dimensioned to rest on top of upper base 18 such that the upper container 4 and lower container 6 may be stored in a vertical stack. Upper container 6 comprises a bottom wall 37 connected to a vertically extending side wall 34 to define an interior space 35 that is accessed through a top opening 36. Bottom wall 37 is connected to side wall 34 to create a substantially horizontal outwardly extending ledge 39 therebetween. The upper base 18 defines an upwardly extending annular rim 28. The bottom of container 6 is dimensioned such that ledge 39 rests on top of the rim 28 and the lateral edge of bottom wall 37 closely fits inside of rim 28 such that rim 28 seats the container 6 on base 18. Because the upper container 6 simply sits on top of upper base 18 the upper container 6 may be freely lifted from base 18 to allow a user to carry the container 6 separate from support 2 and discard the contents of container 6 by inverting the container.

Figure 3:
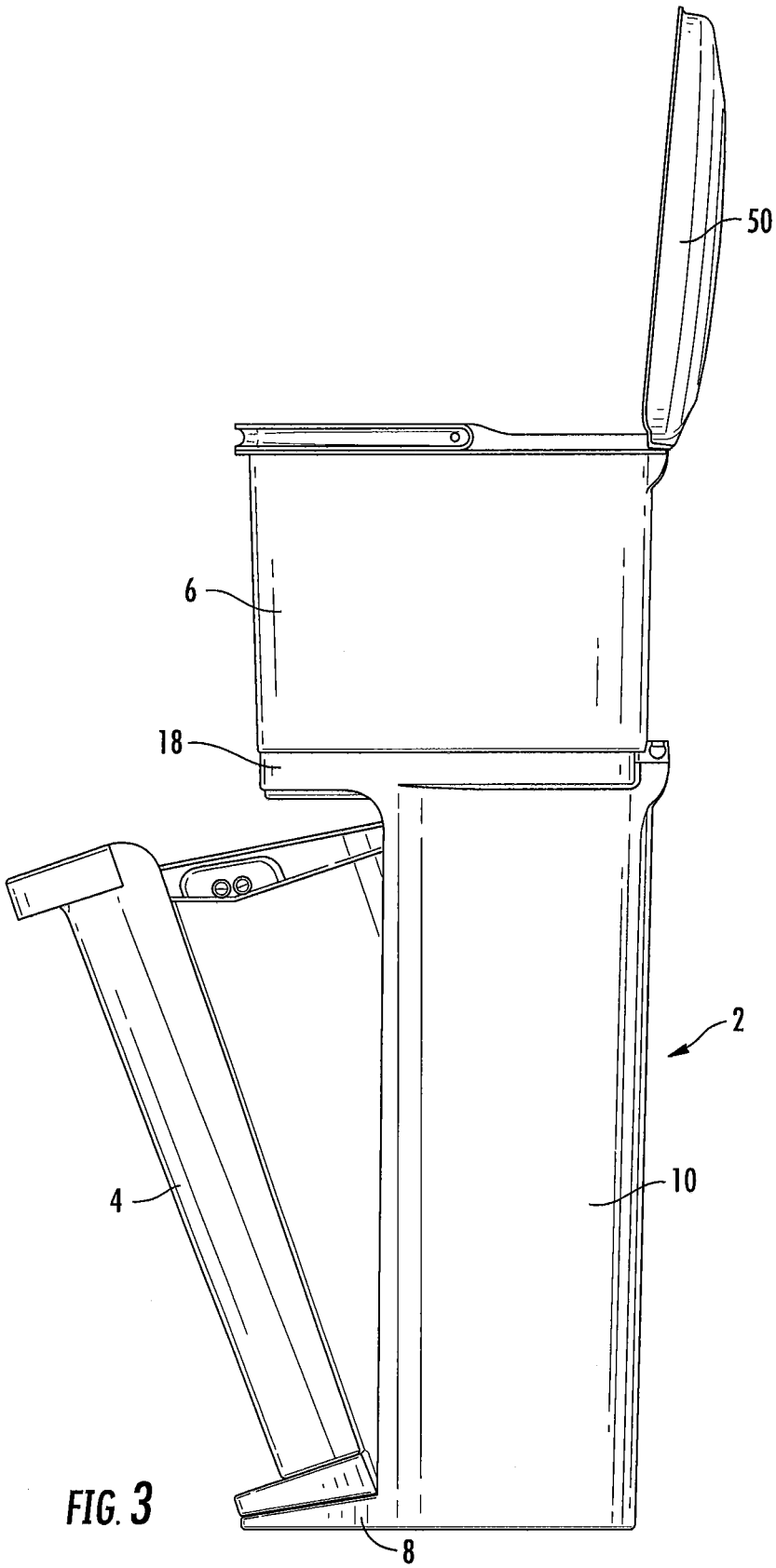
FIG. 3 is a side view of the embodiment of the modular recycling unit of FIG. 1 in the open positions.

The upper container 6 comprises a pivoting lid 50 that is movable between a closed position where the lid is disposed over opening 36 and access to interior space 35 is prevented (FIG. 1) and an open position where the lid is rotated away from container 6 and access through opening 36 to interior space 35 is allowed (FIG. 3). Because containers 4 and 6 may be used with or without a plastic bag liner, the containers, when used without a bag liner, must be able to be freely removed from the support 2 and tipped over or inverted to dump the contents of the containers. The lid 50 may make the emptying of the contents of upper container 6 difficult because the lid 50 will have a tendency to swing open when the container is inverted making the manipulation of the container cumbersome.

To avoid this problem the lid 50 is attached to container 6 at a releasable hinge 59 that allows the lid 50 to be easily removed from the container 6. Referring to FIGS. 2, 4, 6 and 7, container 6 comprises a hinge bar 60 located along the top edge of one side of the vertical wall 34. In one embodiment the hinge bar is located along the rear of the container 6 along the rim that defines opening 36. A cylindrical pocket 62 is formed at each end of the hinge bar 60 such that the pockets 62 are spaced from one another a distance to support the lid as it rotates between the open and closed positions. The pockets 62 open outwardly and have circular bearing surfaces **62*a* that support inwardly extending mating pins 70 formed on the lid 50 for rotational motion. The pockets 62 are axially aligned along the axis of rotation A-A of lid 50. While the pockets 62 are shown as part of a hinge bar 60 that provides a reinforced area at the rim of container 6 the pockets may be formed at the rim of container 6 in other manners. The bearing surfaces 62*a* are interrupted at the top thereof to create passages 64 from the exterior to the interior of the pockets 62 along a vertical axis. Passage 64** has a gap of width G.

Figure 6:
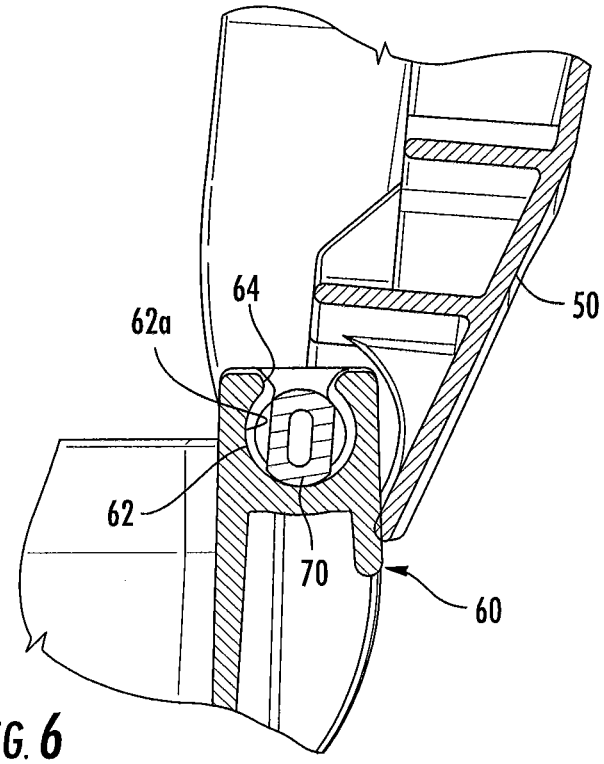
FIG. 6 is a detail section view of an embodiment of a lid hinge used in the modular recycling unit of FIG. 1 in a first position.
Figure 7:
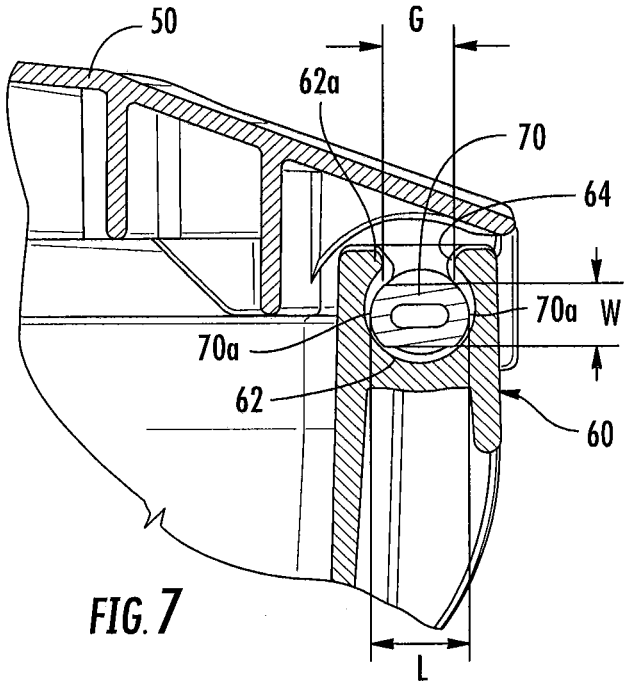
FIG. 7 is a detail section view of the lid hinge of FIG. 6 in a second position.

The lid 50 is formed with a pair of inwardly facing pins 70 that are spaced from one another such that the pins may be received in the pockets 62. Each pin 70 has an oblong shape with a length dimension L that is greater than its width dimension W. The length dimension L is determined such that the pin 70 can freely rotate in the pocket 62 but with a minimum of clearance such that the pin 70 smoothly rotates in the pocket 62. The pins 70 rotate in the pockets 62 on the distal edges 70*a* of the pins between a fully open position and a closed position. The length dimension L may be made slightly smaller than the internal diameter of bearing wall 62*a* but is greater than gap G. The width dimension W of the pin 70 is selected such that is slightly smaller than the width G of passage 64. As a result, when the lid 50 is orientated such that the longitudinal axis of the pin 70 is aligned with the passage 64 as shown in FIG. 6 the pin 70 can be withdrawn from the pocket 62 through the passage 64. The pins 70 may be oriented relative to the lid 50 such that the lid 50 is disposed substantially vertically (in the position of FIG. 4) when the pins 70 are in the aligned position. To remove the lid 50 from container 6 the user rotates the lid until the longitudinal axis of the pins 70 are aligned with the passages 64. The user may lift the lid 50 vertically from the container 6 when it is this position to disengage the pins 70 from pockets 62. The lid 50 may be reattached by orienting the pins 70 relative to passages 64 in the aligned position and lowering the pins 70 into the pockets 62. In any angular position other than the aligned position described above the pins 70 cannot be removed from the pockets 62 because the longitudinal dimension L of the pins 70 is greater than the width of gap G.

Figure 2:
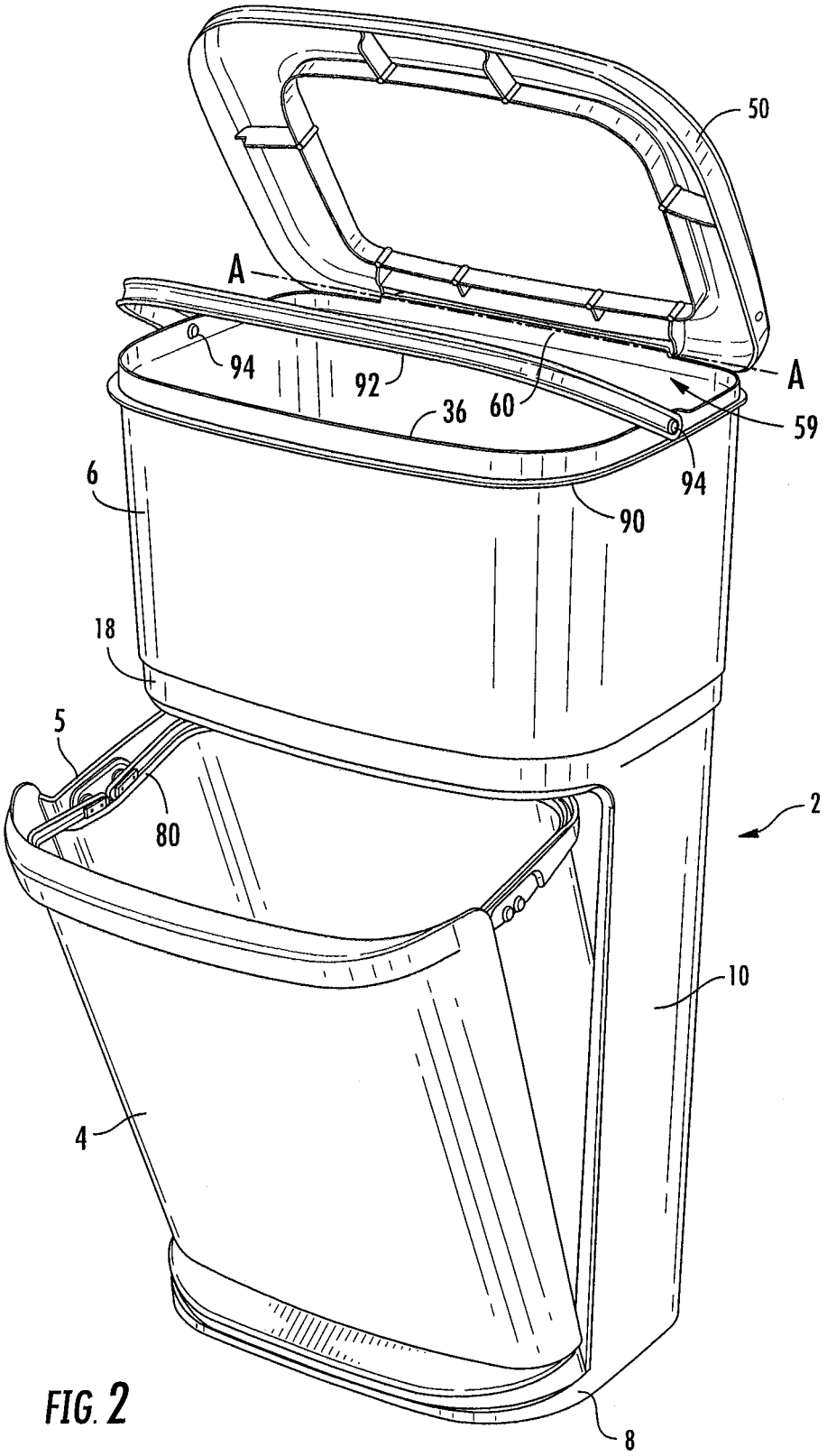
FIG. 2 is a perspective view of the embodiment of the modular recycling unit of FIG. 1 in the open positions.
Figure 8:
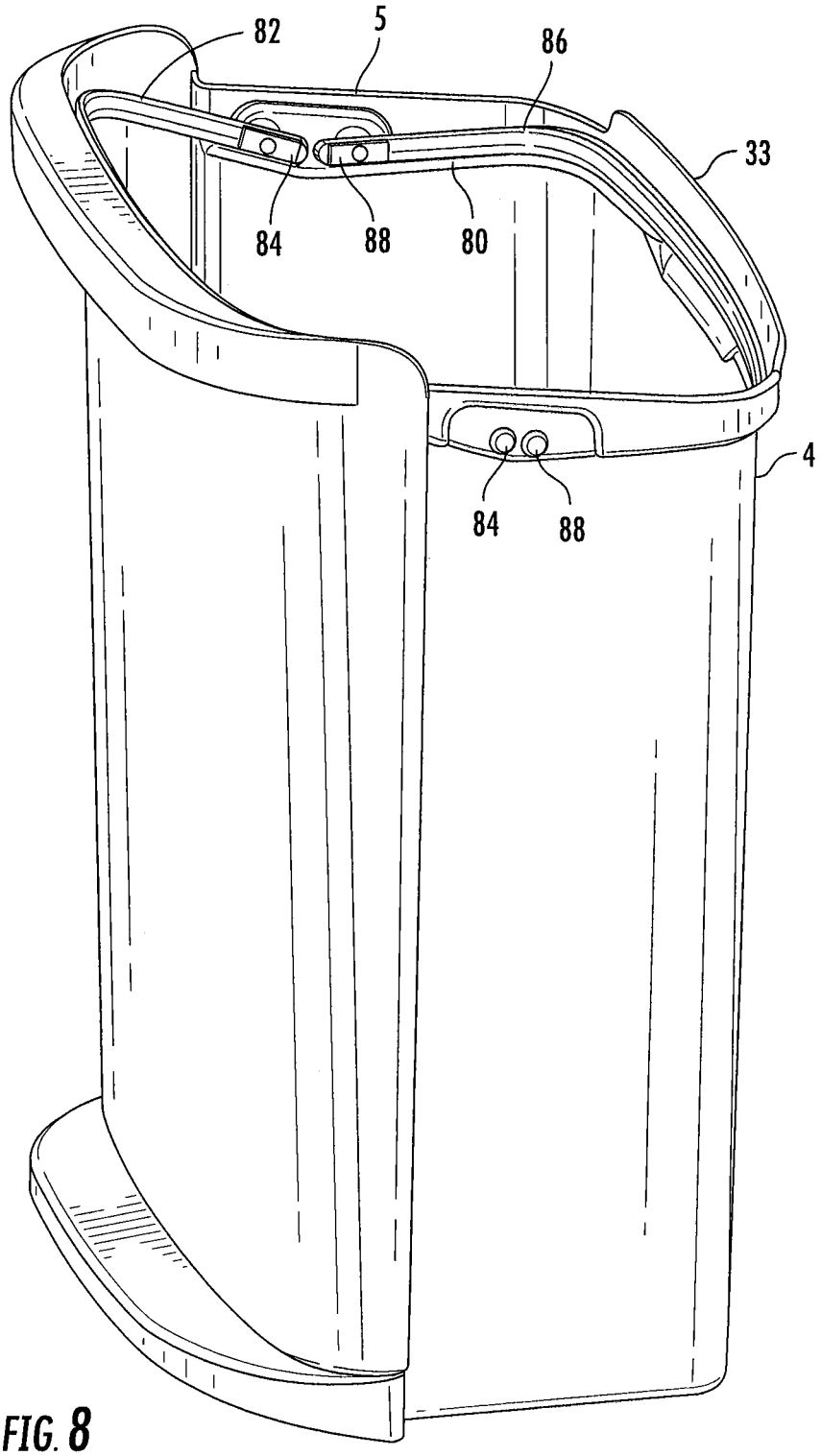
FIG. 8 is a detail view of an embodiment of a combined handle/bag lock used in the modular recycling unit of FIG. 1 in a first position.
Figure 9:
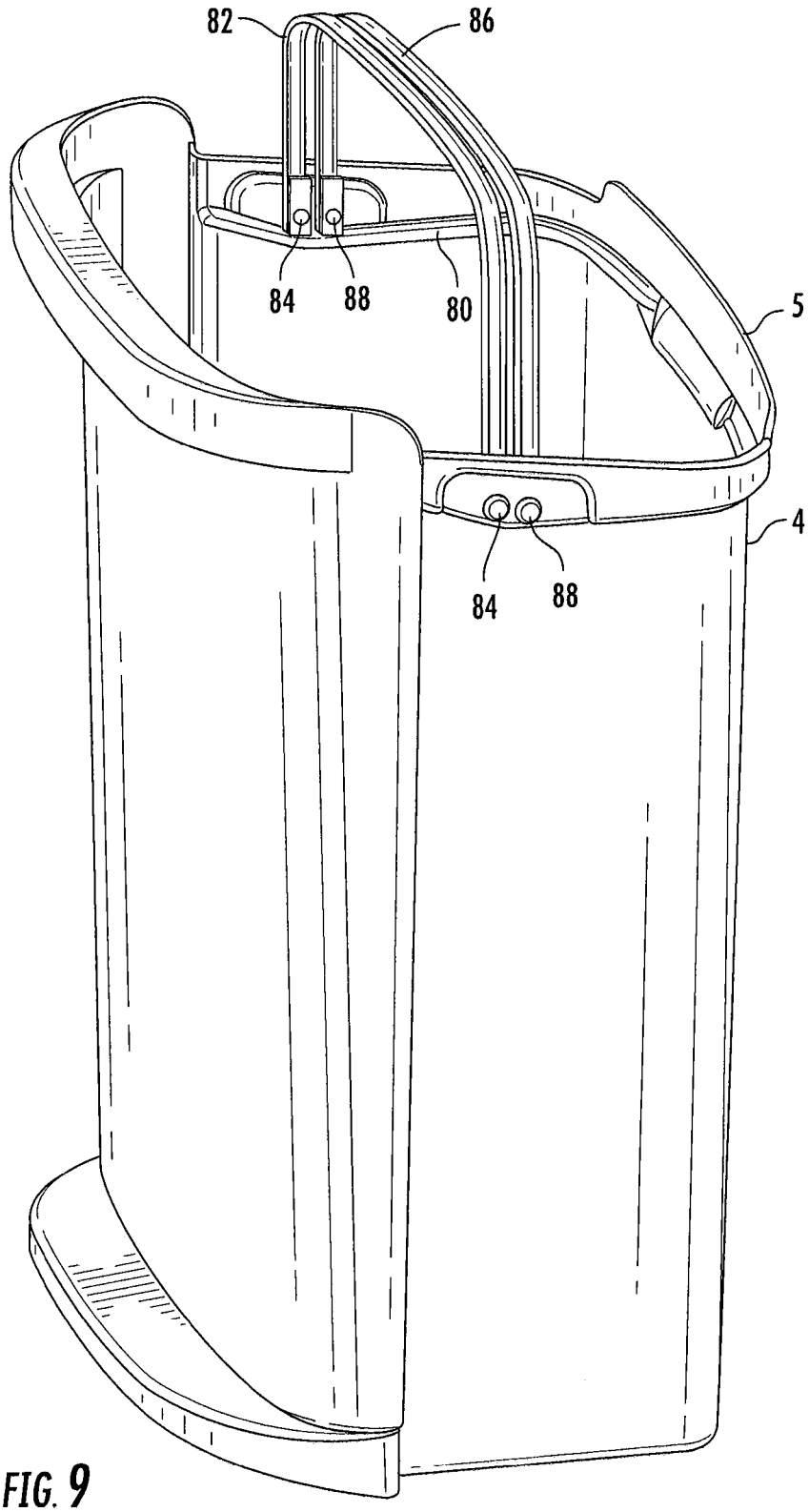
FIG. 9 is a detail view of the handle/bag lock of FIG. 9 in a second position.
Figure 10:
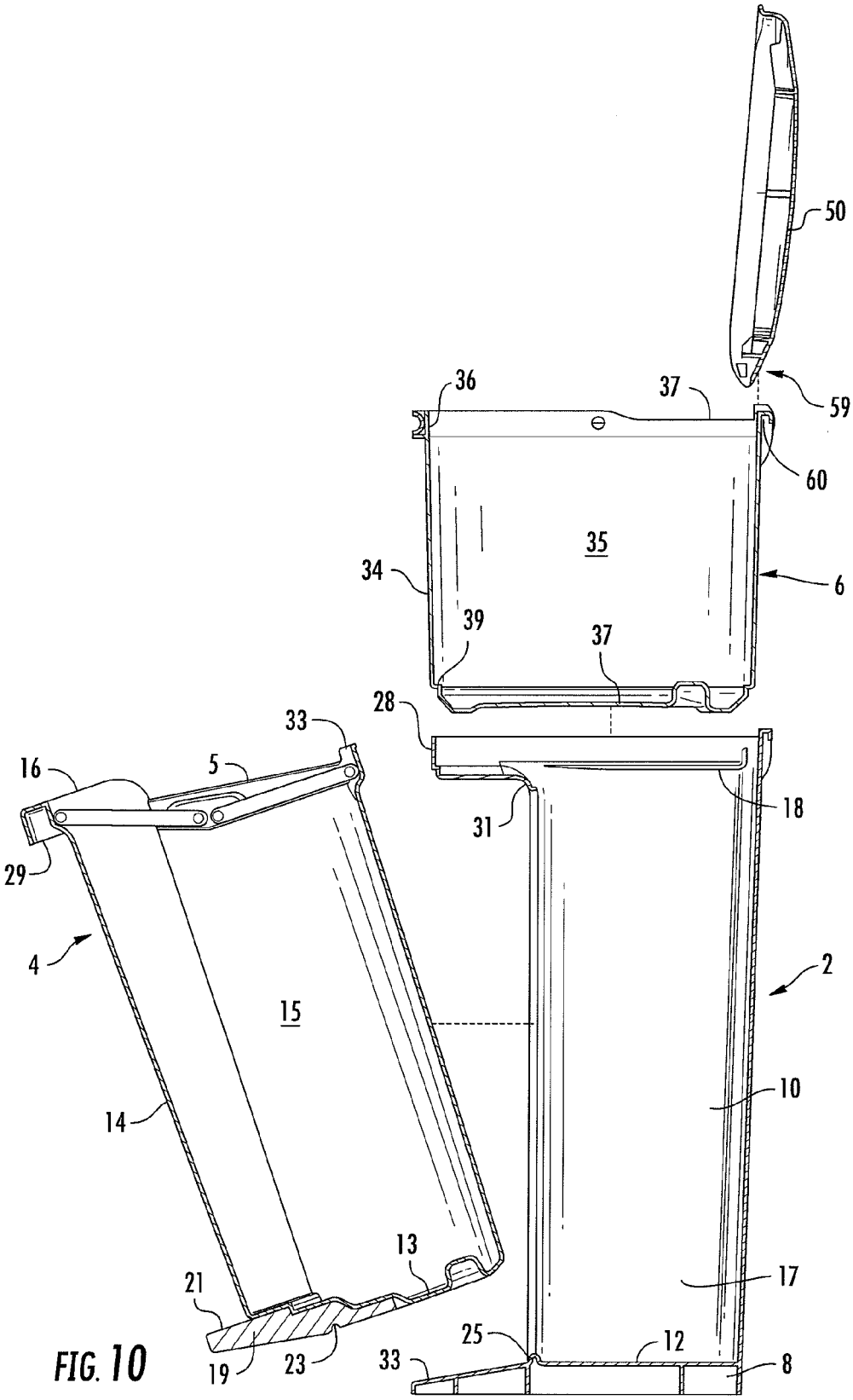
FIG. 10 is a side section view of the embodiment of the modular recycling unit of FIG. 1 showing the modular components separated.

The containers may be used with or without a plastic bag liner. A combination bag lock and handle is provided on each container that serves as a bag lock when a bag liner is used and doubles as a handle for carrying the containers when the containers are removed from the support. Referring to FIGS. 2, 8 and 9 the top edge of the container 4 is defined by a rim 5 that is disposed slightly outside of the wall 14 of the container such that an internal ledge 80 is created between the wall 14 and the rim 5. A first movable member or bail 82 is provided that circumscribes approximately one half of the circumference of the container 4 and that is pivoted at each end at pivots 84 to the container 4. Member 82 may rotate between a first position where it is disposed on the ledge 80 (FIG. 8) and a second position where it extends substantially vertically away from the container (FIG. 9). A second movable member or bail 86 is also provided that circumscribes approximately the other half of the circumference of the container 4 and that is pivoted at each end at pivots 88 to the container 4. Member 86 may rotate between a first position where it is disposed on the ledge 80 (FIG. 8) and a second position where it extends substantially vertically from the container (FIG. 9) adjacent member 82. When the members 82 and 86 are in the raised position they form handles that may be grasped by the user to carry the container 4.

Further, a bag liner may be inserted between the first and second members 82 and 86 and arranged such that the top open edge of the bag liner is folded or draped over the first member 82 and second member 86. The members 82 and 86 are then folded flat against the ledge 80 to the position of FIG. 8 such that the top edge of the bag liner is trapped between the members 82 and 86 and the container 4. Members 82 and 86 may be dimensioned such that a slight interference fit is created between the members and container 4. The bag liner is maintained in the open position with the open edge of the bag liner held adjacent to the opening of the container 4. To remove the bag liner the members 82 and 86 are rotated to release the top edge of the bag liner and the bag liner is lifted out of the container between members 82 and 86.

Referring to FIG. 2, an external ledge 90 is formed adjacent to the top edge of container 6 that extends around at least a portion of the periphery of container 6. A movable member or bail 92 is provided that circumscribes approximately one half of the circumference of the container 4 and that is pivoted at each end at pivots 94 to the container 6 such that member 92 may rotate between a first position where it is disposed on the ledge 90 and a second position where it extends substantially vertically away from the container. Because only a single movable member 92 is provided on container 6, pivots 94 are located along the centerline of the container 6. While only a single movable member 92 is provided, two internal bails may be provided on container 6 as shown and described with respect to container 4 if desired. When the bail 92 is in the raised position it forms a handle that may be grasped by the user to carry the container.

Further, a bag liner may be inserted into the container such that the top open edge of the bag liner is folded or draped over the rim of container 6. The movable member 92 is then folded flat against the ledge 90 such that the top edge of the bag is trapped between the member 92 and ledge 90 such that the bag is maintained in the open position with the open top edge of the bag liner held adjacent to the opening 36 of the container 6. Member 92 may be dimensioned such that a slight interference fit is created between the member and container 6. The bag liner is maintained in the open position with the open edge of the bag liner held adjacent to the opening of the container 6. To remove the bag liner the member 92 is lifted to release the bag liner.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A modular recycling unit comprising:

a support for supporting a first container comprising an interior, the first container being tiltable between a first position where the interior of the first container is accessible and a second position where the interior of the first container is inaccessible, the first container comprising a bottom including a rear portion and an a front portion disposed at an angle relative to the rear portion such that a fulcrum is created between the rear portion and the front portion, the first container tilting on the fulcrum between the first position and the second position, the fulcrum comprising a rounded projection on one of the support and the bottom of the first container that is received in a recess on another one of the bottom of the first container and the support, said first container being freely removable from the support;

a second container supported on the support such that the second container is in a stacked relationship relative to the first container, the second container being freely removable from the support;

a lid pivotably secured to the second container and rotatable about a pivot axis between a first closed position and a second position where the lid may be completely removed from the second container.

2. The modular recycling unit of claim 1 wherein the support comprises a generally horizontally disposed lower base and a stanchion that extends vertically from the lower base.

3. The modular recycling unit of claim 2 wherein a top surface of the lower base defines a supporting surface for the lower container.

4. The modular recycling unit of claim 2 wherein the stanchion supports a generally horizontal upper base that is spaced from the lower base a distance that allows the first container to fit between the upper base and the lower base, the upper base supporting the second container.

5. The modular recycling unit of claim 4 wherein when the first container is in the second position an opening of the first container is disposed beneath the upper base.

6. The modular recycling unit of claim 1 further comprising a foot pedal for rotating the first container about the fulcrum.

7. The modular recycling unit of claim 1 wherein the lid is attached to the second container at a releasable hinge.

8. The modular recycling unit of claim 7 wherein one of the lid and the second container comprises a cylindrical pocket comprising a circular bearing surface having a passage that communicates to the exterior of the pocket and another one of the lid and the second container is formed with a pin mounted for rotational movement in the pocket such that in a first orientation of the pin relative to the pocket the pin may be removed from the pocket.

9. The modular recycling unit of claim 8 further comprising a second pocket engaged by a second pin.

10. The modular recycling unit of claim 8 wherein the passage has a gap of a first width and the pin has an oblong shape with a length dimension that is greater than a width dimension and the length dimension is greater than the first width and the width dimension is smaller than the first width.

11. The modular recycling unit of claim 8 wherein in the first orientation the longitudinal axis of the pin is aligned with the passage.

12. A modular recycling unit comprising:

a support for supporting a first container comprising an interior, the first container being tiltable between a first position where the interior of the first container is accessible and a second position where the interior of the first container is inaccessible, said first container being freely removable from the support;

a second container supported on the support such that it is in a stacked relationship relative to the first container, the second container being freely removable from the support;

a lid pivotably secured to the second container and rotatable about a pivot axis between a first closed position and a second position where the lid may be completely removable from the second container;

a first movable member that circumscribes approximately one half of the circumference of the first container and that is pivoted at each end to the first container such that the first movable member may rotate between a first position where it is disposed adjacent the opening of the first container and a second position where it extends substantially away from the first container and a second movable member that circumscribes approximately another half of the circumference of the first container and that is pivoted at each end to the container such that it may rotate between a first position where it is disposed adjacent the opening of the first container and a second position where it extends substantially away from the container, the first and second members forming handles in the first position and a bag lock in the second position such that a bag liner may be trapped between the first and second members and the first container when the first and second members are in the second position.

13. The modular recycling unit of claim 12 comprising a third movable member that circumscribes approximately one half of the circumference of the second container and that is pivoted at each end to the second container such that the third movable member may rotate between a first position where it is disposed adjacent the opening of the second container and a second position where it extends substantially away from the second container.

14. The modular recycling unit of claim 12 wherein the support comprises a generally horizontally disposed lower base and a stanchion that extends vertically from the lower base wherein a top surface of the lower base defines a supporting surface for the lower container and wherein the stanchion supports a generally horizontal upper base that is spaced from the lower base a distance that allows the first container to fit between the upper base and the lower base, the upper base supporting the second container.

15. The modular recycling unit of claim 14 wherein when the first container is in the second position an opening of the first container is disposed beneath the upper base.

16. The modular recycling unit of claim 12 wherein the first container comprises a bottom including a rear portion and an a front portion disposed at an angle relative to the rear portion such that a fulcrum is created between the rear portion and the front portion, the first container tilting on the fulcrum between the first position and the second position.

17. The modular recycling unit of claim 16 further comprising a foot pedal for rotating the first container about the fulcrum.

18. A modular recycling unit comprising:

a support for supporting a first container comprising an interior, the support comprising a generally horizontally disposed lower base and a stanchion that extends vertically from the lower base wherein a top surface of the lower base defines a supporting surface for a second container and wherein the stanchion supports a generally horizontal upper base that is spaced from the lower base a distance that allows the first container to fit between the upper base and the lower base, the upper base supporting the second container, the first container being tiltable between a first position where the interior of the first container is accessible and a second position where the interior of the container is inaccessible, said first container being freely removable from the support;

the second container supported on the support such that it is in a stacked relationship relative to the first container, the second container being freely removable from the support;

a first movable member that circumscribes approximately one half of the circumference of the first container and that is pivoted at each end to the first container such that the first movable member may rotate between a first position where it is disposed adjacent the opening of the first container and a second position where it extends substantially away from the first container and a second movable member that circumscribes approximately another half of the circumference of the first container and that is pivoted at each end to the container such that it may rotate between a first position where it is disposed adjacent the opening of the first container and a second position where it extends substantially away from the container, the first and second members forming handles in the first position and a bag lock in the second position such that a bag liner may be trapped between the first and second members and the first container when the first and second members are in the second position.

* * * * *